US007055393B2

(12) United States Patent
Smith

(10) Patent No.: US 7,055,393 B2
(45) Date of Patent: Jun. 6, 2006

(54) BLIND FASTENER SETTING TOOL

(75) Inventor: Daniel Robin Smith, Birmingham (GB)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/619,233

(22) Filed: Jul. 14, 2003

(65) Prior Publication Data

US 2004/0060363 A1 Apr. 1, 2004

(30) Foreign Application Priority Data

Jul. 18, 2002 (GB) ..... 0216722

(51) Int. Cl.
*G01B 7/16* (2006.01)
*G01L 1/00* (2006.01)

(52) U.S. Cl. ..... 73/774

(58) Field of Classification Search ..... 73/774, 73/849, 756; 439/894; 700/175; 29/716, 29/243.525, 243.521, 243.524, 243.523; 227/2; 72/391.6; 411/501; 310/325
See application file for complete search history.

(56) References Cited

U.S. PATENT DOCUMENTS

| | | | | |
|---|---|---|---|---|
| 3,772,538 | A * | 11/1973 | Supitilov | 310/325 |
| 4,163,311 | A | 8/1979 | Sigmund | |
| 4,173,725 | A * | 11/1979 | Asai et al. | 310/325 |
| 4,314,481 | A | 2/1982 | Wolfer et al. | |
| 5,354,160 | A * | 10/1994 | Pratt et al. | 411/501 |
| 5,661,887 | A | 9/1997 | Byrne et al. | |
| 5,666,710 | A | 9/1997 | Weber et al. | |
| 5,841,675 | A | 11/1998 | Ngo | |
| 6,276,050 | B1 * | 8/2001 | Mauer et al. | 29/716 |
| 2001/0039718 | A1 | 11/2001 | Mauer et al. | |
| 2004/0063362 | A1 * | 4/2004 | Weeks et al. | 439/894 |

FOREIGN PATENT DOCUMENTS

| | | |
|---|---|---|
| DE | 44 01 134 A1 | 7/1995 |
| DE | 4401155 | 7/1995 |
| DE | 4429225 | 2/1996 |
| EP | 0594333 A1 | 4/1994 |
| EP | 0 738 551 A2 | 10/1996 |
| EP | 0893179 A2 | 1/1999 |
| EP | 0 995 518 A2 | 4/2000 |
| EP | 1302258 | 4/2003 |
| EP | 1 382 406 A2 | 1/2004 |
| WO | WO03/059551 A1 | 7/2003 |

* cited by examiner

*Primary Examiner*—Max Noori
*Assistant Examiner*—Octavia Davis
(74) *Attorney, Agent, or Firm*—Harness, Dickey & Pierce, P.L.C.

(57) ABSTRACT

There is provided a blind fastener setting tool (12) which has a front end face (218) against which a blind fastener (14) is held during a conventional setting operation and which further has a piezo-electric thin film load measuring device (222) mounted on this front face so as to be disposed and compressed between the front face (218) and a flange (122) of the fastener (14) during the setting operation so as to record a low voltage electrical signal indicative of the load being exerted thereon.

There is further provided a method of measuring such load during the setting of a blind fastener by positioning a piezo-electric thin film load measuring device between a setting tool and a fastener and subsequently measuring a low voltage signal created as a result of deformation of the piezo-electric thin film during the setting operation and analysing this signal as indicative of the load exerted on the fastener.

9 Claims, 1 Drawing Sheet

BLIND FASTENER SETTING TOOL

FIELD OF THE INVENTION

The present invention relates to an improved setting tool for use in setting blind fasteners such as blind rivets. More particularly, the invention is directed to a setting tool having an improved means and method of monitoring the load applied to the blind fastener during the setting procedure.

BACKGROUND AND SUMMARY

For a number of reasons, it is highly desirable during the setting of blind fasteners, such as blind rivets, to monitor the load being applied to the fastener during the setting operation and comparing the determined load values against predetermined reference values to monitor and analyse the quality of the setting operation in order to provide a confidence factor that the fastener has been correctly set. This is particularly advantageous since such blind fasteners are often used in situations where it is difficult to visually confirm acceptability of the set fastener (ie. the "blind side" is often located in an internal surface of a sealed box or container which cannot be viewed by the operator).

Conventional setting tools for use with blind fasteners work on the principle of providing a front end surface of a setting tool to restrain the flange portion of the blind fastener and for a mandrel stem of the blind fastener to pass therethrough to be engaged by a set of pulling jaws whereby such pulling jaws are drawn inwardly for the setting tool to exert a displacement force or setting force on the mandrel stem to effectively draw a mandrel head into the fastener body to deform the free end of the fastener against an appropriate work surface. Often a hydraulic or pneumatic force is utilised to effect displacement of the pulling jaws and the measurement of the force applied to the mandrel stem is determined by analysis of the pressure applied by the hydraulic or pneumatic fluid, usually via a pressure transducer, used to drive a uniform piston attached to such jaws. The applicant's earlier European Patent No. EP0 738 8551 discloses such a conventional load measuring system for a blind rivet setting tool.

It has also been known to utilise conventional strain gauges interconnected between the tool body and the setting jaws to again measure the load exerted on the fastener dependent on the displacement of the jaws themselves.

Whilst highly effective in determining the load transferred from the setting jaws of such conventional rivet setting tools to the mandrel of this fastener during the setting operation, these types of existing load measuring systems are highly complex and require careful positioning internally of the rivet setting tool making manufacture of such tools difficult and the repair and replacement of worn or damaged measurement devices extremely difficult.

It is therefore an object of the present invention to provide a blind fastener setting tool having an improved load measuring device which alleviates the aforementioned problems in a simplistic and cost effective manner.

According to the present invention there is now provided a blind fastener setting tool having a front face against which a blind fastener is held during a setting operation, and having a piezo-electric thin film load measuring device mounted on the front face so as to be disposed and compressed between the front face and the fastener during the setting operation. In this manner, the compressive force exerted by the fastener on the load measuring device will generate a low voltage signal indicative of the load being exerted thereon during the setting operation.

Preferably, the end face will be mounted on the tool by a bridge member so as to form a cantilever which is subject to bending when a load is exerted on the fastener by the setting tool. Here the load measuring device will usually comprise a bending piezo-electric generator which is securely mounted on the front face, wherein the bending deformation of the generator, resultant from the bending deformation of the cantilever, will generate a low voltage electrical signal.

Preferably, the front face of the setting tool will have a central aperture therethrough providing communication with the internal mechanism of the tool, this aperture being coaxial with a longitudinal axis of the setting tool and being for receipt of a mandrel of the fastener, wherein the load measuring device further comprises an aperture so as to be mounted again coaxial with the tool axis.

It is also preferable that a protective cover is mounted on an external surface or face of the measuring device to protect the thin film piezo-electric material from mechanical damage from engagement with the fastener.

Further and according to the present invention there is also provided a system for measuring the load exerted on a blind fastener by a fastener setting tool during a setting operation which comprises a setting tool as discussed above and further has a control circuit for analysing a voltage output of the piezo-electric thin film load measuring device as indicative of the load exerted from the fastener.

Still further according to the present invention, there is also provided a method of measuring the load exerted on a blind fastener by a fastener setting tool during a setting operation which comprises the steps of firstly positioning a piezo-electric thin film load measuring device between a front end face of the tool and a fastener mounted on the tool, subsequently compressing the fastener towards the end face during the setting operation so as to compress and deform the measuring device, following which a voltage signal created as a result of deformation of the piezo-electric thin film is measured, and this measured signal is then analysed as indicative of the load exerted on the fastener.

Preferably, where the load measuring device is mounted on a cantilevered front end face of a setting tool such that this end face is caused to bend as a compressive force is applied thereto, the deformation of the piezo-electric thin film comprises a bending deformation to generate the electrical signal.

There is further provided a method of determining a free set operation of a fastener setting tool by measuring the load exerted on a blind fastener comprising the step of determining the measured time difference between the mandrel entry load and the mandrel setting load of such fastener and comparing it against a predetermined time difference value indicative of an optimum setting time difference and generating an output signal in the event that the measured time difference is greater than the predetermined time difference indicative of a free set operation.

BRIEF DESCRIPTION OF THE DRAWINGS

A preferred embodiment of the present invention will now be described, by way of example only with reference to the accompanying illustrative drawings in which.

DETAILED DESCRIPTION

Figure 1:
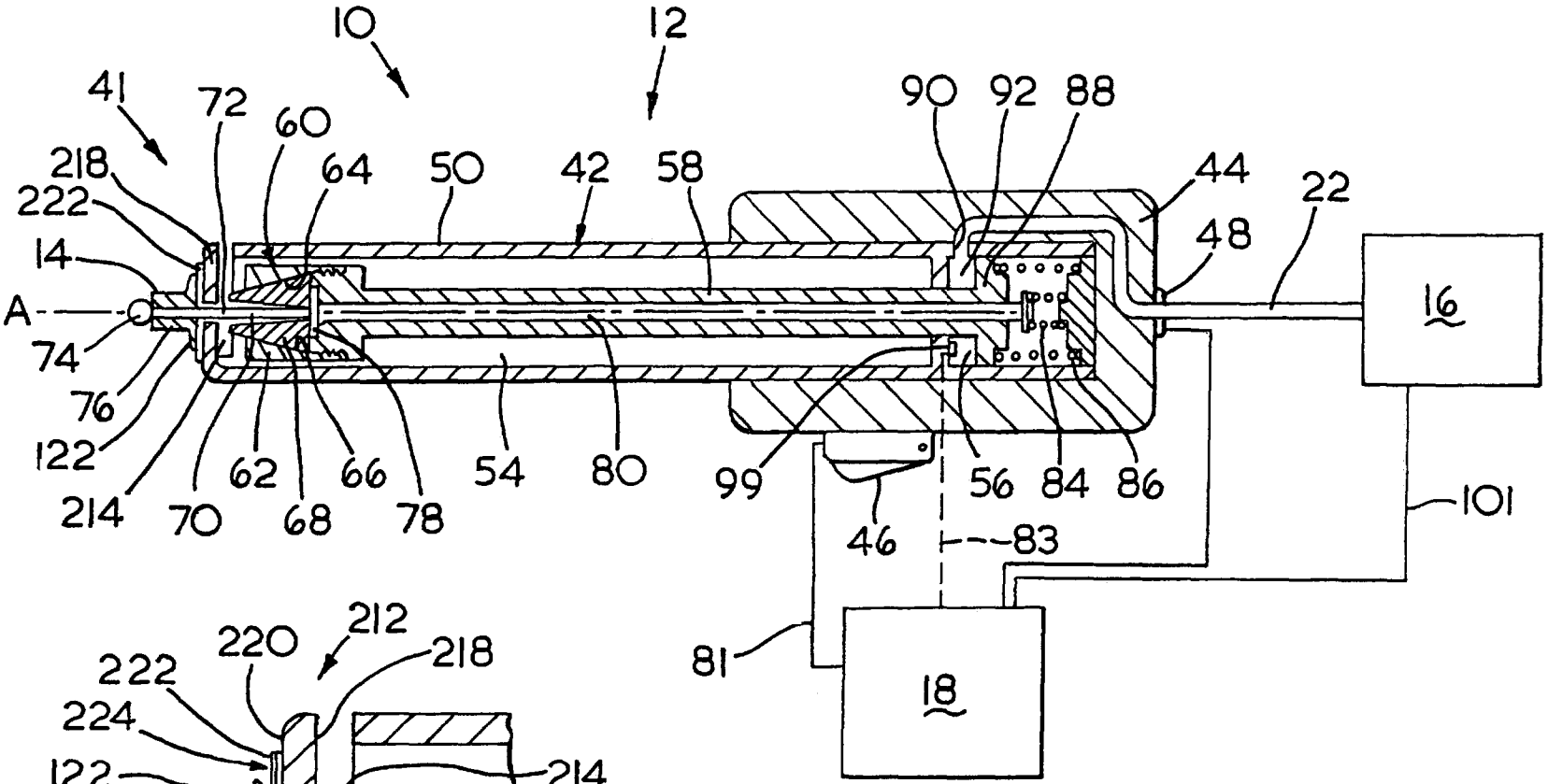
FIG. 1 is a schematic cross sectional view of a blind fastener setting tool according to the present invention.

Referring now to FIG. 1, a conventional blind rivet setting tool (12) is schematically illustrated. A blind rivet setting system (10) comprises the rivet setting tool (12) for setting a blind rivet (14), a hydraulic intensifier (16) and system control circuit shown schematically as (18). The intensifier (16) may be any one of a number of conventional such intensifiers commonly used within the art but may simply be considered as a fluid pressure source for controllably applying pressure to the setting tool (12) by means of hydraulic fluid transferred via a fluid connection pipe (22). Often, intensifiers (16) of this type employ a pressure source, such as pressurised air applied to a cylinder, to compress a hydraulic oil or fluid to transfer fluid pressure to the setting tool. The fluid contained in the intensifier (16) may be considered to be in continuous fluid communication, through pipe (22), with the rivet setting tool (12).

The tool (12) comprises an elongated body generally illustrated as (42) which may be of any of several constructions but is preferably shown here provided with a handle (44). A trigger switch (46) which actuates to the tool (12) is fitted in the handle (44) in a conventional manner and is operatively associated with a valve (48).

As for conventional rivet setting tools, the tool (12) is further provided with an electronic control circuit (18) which is operatively connected, via wire (81) to the switch (46) such that actuation of the switch (46) will commence operation of the rivet setting cycle of the tool (12) in a conventional manner. Here the control circuit controls the operation of the associated valve (48) via control wire (91) and controls operation of the intensifier (16) via control wire (101) so that the rivet setting tool follows a predetermined setting cycle as will be described hereinafter.

The elongated body (42) includes an elongated housing (50), which is sub divided internally into a front chamber (54) and a hydraulic cylinder chamber (56), wherein the elongated body (42) further includes an axially movable pulling shaft (58) provided along its longitudinally extending axis. It will be understood that the construction of the housing (50) is only one of a significant number of variations, where the only essential feature being that it provides support for the pulling shaft (58) and for a means of axially moving this shaft (58).

A jaw assembly (60) is operatively associated with a front end of the pulling shaft (58). The jaw assembly (60) includes a jaw cage (62) having an internal bevelled wedging surface (64) that defines an internal bore (66). An array of split jaws (68) are movably provided within the cage (62). When the outer surfaces of the split jaw (68) act against the bevel surfaces (64), the jaws (68) engage and grip an elongated stem (70) of a mandrel (72) of a blind rivet (14). The mandrel (72) also includes a mandrel head (74). The mandrel (72) comprises the head forming component of the rivet (14) as is known in the art. The rivet (14) includes a tubular deformable sleeve (76). A variety of methods may be employed to manipulate the jaw assembly (60) to grasp and hold the stem (70) of the mandrel (72), but the method described hereafter is merely illustrative and is not limiting on the invention.

Figure 2:
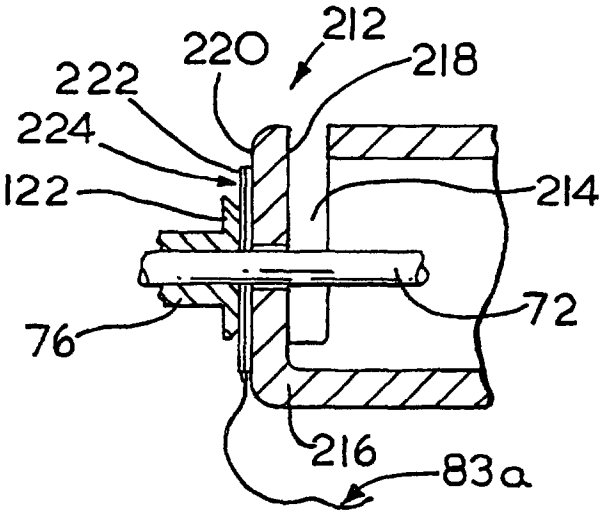
FIG. 2 is an enlarged schematic cross sectional view of the load measuring device of the setting tool of FIG. 1.

A front end (41) of the housing (50) comprises a front end face (218) having a central aperture extending therethrough which is aligned coaxially with the axis A of the setting tool (12) which has an outwardly directed or front face (220) which is substantially perpendicular to the tool axis A, as is conventional for setting tools of this type and supports a flange (122) of the blind rivet (14) in a conventional manner and as shown in FIG. 1 and FIG. 2. In this manner, the mandrel (72) will extend through the aperture in this front plate (218) and be received within the jaw assembly (60) in a conventional manner. This front plate (218) serves to prevent axial displacement of the deformable sleeve (76) of the rivet as the mandrel is drawn from left to right by operation of the setting tool.

The setting tool (12) of the present invention differs from setting tools according to the prior art whereby a slot (214) extends transversely to the axis A through the front chamber (54) of the body (50) leaving a supporting bridge (216) (FIG. 2) connecting front plate (218) to the rivet tool body (42) about a limited diameter of the body (50). Preferably the bridge section (216) may extend about up to 35% of the diameter of the body (50). However, it would be appreciated that the bridge (216) could alternatively comprise a plurality of fingers extending between the front plate and the body (50), such fingers again defining a maximum arc no greater than 35% of the diameter of the body. In this manner, the bridge (216) creates a cantilever with the front plate (218) as will be described later.

A pusher (78) is fixed to the forward end of a pusher rod (80), which itself is housed within a central through bore defined in the pulling shaft (58). The pusher rod (80) is axially movable within this through bore and is biased, at this rear end, against the back wall of the hydraulic cylinder chamber (56) by a spring (84). A weaker spring (86) acts between the same wall and the rear end of the pulling shaft (58).

A piston (88) is fixed to the pulling shaft (58) and is capable of axial motion in both forwards and rearwards direction within the hydraulic cylinder chamber (56). The hydraulic intensifier (16) forces a pressurised fluid (not shown) through the pipe (22) into the cylinder chamber (56) on the forwards side of the piston (88) through a pressurised fluid port (90) into a pressurisable side (92) of the hydraulic cylinder chamber (56). By introducing a pressurised fluid in the fluid-tight chamber defined within the pressurisable side (92), the piston (88) is forced to move rearwardly (from left to right as viewed in FIG. 1), causing the jaw member (68) to clamp and apply a setting force to the mandrel stem (70) eventually causing it to break away from the mandrel head (74) as will be described below.

The name "blind rivets" is derived from the fact that such rivets are installed from only one side of a workpiece or application, the primary side the blind rivet (14) includes the tubular rivet sleeve (76) having a flange (122) at its rear end as shown in FIG. 1. The mandrel (72) has a stem (70) that passes through the tubular rivet body or sleeve (76) and has an enlarged mandrel head (74) formed at one end thereof. Although not shown, the mandrel stem is provided with a weakened portion which has a pre-determined breakpoint which will break when a sufficient load is applied. This is conventional within the field of blind rivet setting and need not be discussed in any great detail herein. The rivet (14) is loaded within the setting tool (12) as shown in FIG. 1 and then introduced into a hole passing through an appropriate workpiece (not shown) such that the mandrel head and forward end of the sleeve (76) project through to the "blind side" of the workpiece. The mandrel stem (70) is then clamped between the split jaws (68) and is pulled by the setting tool (12). As the pulling shaft (58) is forced rearwardly (left to right) by fluid pressure being introduced into the hydraulic cylinder chamber (56) so as to displace the piston (88) against the resistance of the weakest spring (86), the pusher rod (80), biased against the stronger spring (84), resists this rearward movement causing the pusher (78) to act against the rear of the split jaw (68) pushing them into and against the tapered internal bevelled wedging surface (64) causing the jaws to grip to the mandrel stem (70). Once the stem is gripped, the split jaw (68) are fully lodged between the surface (64) and the mandrel stem (70), the pusher rod (80) moves rearwardly with the pulling shaft (58), the biasing force of the strongest springs (84) now having been overcome. As the jaw assembly (60) is carried rearwardly by movement of the pulling shaft (58) (resulting from an increase in pressure in the chamber (56)) the head (74) of the rivet (14) is drawn into and enters the sleeve (76) as is conventional for setting of such blind rivets. This is denoted as the "mandrel entry point" and is the point at which the sleeve (76) begins to deform as the enlarged mandrel head is drawn therein. The pressure or load being exerted at this stage is referred to as the mandrel entry load. As the mandrel (72) continues to be pulled, the rivet sleeve (76) is deformed up to the secondary or blind side of the workpiece being clamped and this deformed part of the sleeve (76) acts as secondary clamping element, whereas the flange (122) becomes the primary clamp element such that the workpieces are clamped therebetween. It is this combination of the secondary and primary clamp elements that hold two or more parts of an application or workpiece together.

Continued rearward movement of the jaw assembly (60) by movement of the pulling shaft (58), pulls the head (74) into the sleeve (76) causing maximum deformation. Once the head (74) reaches the secondary side, it is restrained from further axial displacement and the mandrel (72) therefore breaks at the neck portion previously described, the force being applied at breakpoint being referred to as the maximum setting force (or load), wherein the secondary clamp element is now created by the combination of the now detached head (74) being retained within the deformed sleeve (76). The fluid pressure within the chamber (56) is then released by releasing the setting tool trigger (46) and effecting appropriate control and displacement of the hydraulic intensifier (16), whereby both the pulling shaft (58) and the pusher rod (80) are restored to their pre-engaged positions by the biasing forces of the springs (84 and 86). With the force of the jaws (68) removed, the jaws (68) are relaxed to their pre-engaged positions and the stem (70) is released and discarded. The tool (12) is then ready to repeat this rivet setting cycle.

In addition, and for illustrative purposes, the setting tool (12) of FIG. 1 is further shown comprising a conventional pressure transducer (99) mounted within the hydraulic cylinder chamber (56) for measuring the hydraulic fluid pressure applied to the piston (88) and provides an electrical output signal indicative of the pressure detected, via control wire (83) to be measured by the control circuit (18) which is able to convert such an output signal into a pressure measurement. Since the area of the piston (88) is constant this pressure measurement will then be indicative of the force being transmitted through the jaws to the mandrel stem (72). This is a conventional means of measuring the setting force being applied during the rivet setting operation. Usually the system control circuit (18) will employ an appropriate conditioning circuit for converting an analogue signal to a digital signal which can then be passed through an appropriate amplifier circuit for monitoring the signal throughout the riveting cycle or, alternatively, sampling the transducer circuit at predetermined time intervals. However as will be appreciated from FIG. 1, the transducer (99) must be placed internally of the rivet setting tool (12) adding to the complex manufacturing process of assembling such a tool and making repairs or replacement of such measurement transducers.

Referring now to FIG. 2, the improved load measuring means is shown, wherein a piezo-electric device can be utilised to directly measure the load applied to the blind rivet during the setting operation.

As previously described, the front end of the elongated body (42), in the region of the setting tool jaw assembly, (68), is provided with an additional slot (214) to form leave a supporting bridge (216) connecting the body (42) to the remote end plate (218) which engages and supports the rivet body flange (122) during the rivet setting operation (as shown). This supporting bridge (216) and end plate (218) create a cantilever which has mounted on its outwardly directed (or front face) (220) a piezo-electric thin film load indicating device (222) which is bonded by chemical bonding means such as an epoxy two part adhesive or a cyano-acryalate single part adhesive to be securely mounted thereon. A protective pad (224) is further bonded to the outer surface of the piezo-electric thin film load indicating device which protects the thin film load indicating device from mechanical damage by engagement with the rivet flange (122).

The rivet mandrel stem (70) passes through a central co-axial aperture in the cantilevered end face (218), which aperture also extends co-axially through the piezo-electric device and the protective pad, so as to be engaged by the setting jaws (68) of the tool (210). In this manner, it will be appreciated that the only significant difference in the mechanical structure of this setting tool compared to setting tools of the prior art is that the end face is now cantilevered as opposed to being rigidly supported on the elongate body (42).

As the load is applied to the stem (70) of the mandrel this load will be transmitted, via the mandrel head (74) and through the rivet body (76) and flange (122) to the front end plate (218) which will, in turn, cause the front cantilever face (218) to bend about the supporting bridge (216) whereby the higher the applied load then the cantilever will bend to a greater extent. It will also be appreciated that since this outer face of the cantilever is bending, the surface is in tension and, accordingly, this tendency for increase in length will also apply to the securely bonded piezo-electric device. The increase in tension and subsequent deformation of the piezo-electric device is related directly to the amount of strain induced into the cantilever and is thus converted directly to a low electrical voltage that can be received by the system control circuit (18) via appropriate wires (83*a*).

The resultant electric signal from the piezo-electric load indicating device (222) can then be analysed by the control circuit in a conventional manner to provide a direct output indicative of load being applied to the mandrel stem (72).

Piezo-electric thin film load indicating devices are well understood in the art and comprise a variety of different designs. Specifically in the embodiment described herein the piezo-electric thin film load indicating device may comprise a two-layer piezo-electric generator comprising a laminated two-layer element whereby when the applied mechanical force causes the cantilever to bend, the polarised two-layer element of the piezo-electric device also bends, whereby one layer is pressed and the other is stretched so that charge develops across each layer in an effort to counteract the imposed strains and it is this charge that is subsequently detected and analysed by the control circuit. However, since this technology is considered commonplace and widely understood the specific details of the operation of the piezo-electric load sensing devices of this type will not be described in any great detail here save to understand that a low voltage electrical signal is generated upon deformation of, such material under an applied load, which voltage is indicative of the load subsequently applied.

The control circuit can subsequently be calibrated so as to analyse and convert the measured output signal of the piezo-electric device to produce an exact measurement of the load applied to the mandrel stem, or may simply output an uncalibrated signal which is indicative in the change of load applied during the rivet setting cycle. This uncalibrated signal will be of specific interest whereby the rivet setting procedure is analysed by consideration of the setting time between various peaks and troughs in a continuous load versus time measurement curve whereby this specific value of the applied load is not essential to determination of the quality of the set rivet. However in other operations, the load values are specifically required and thus it will be necessary to calibrate the control circuit accordingly. Specifically, during a rivet setting operation the load applied to the mandrel stem will initially increase until such time that the mandrel head exerts sufficient force to effect deformation of the cylindrical body of the rivet and is able to be drawn therein. During this deformation stage the load exerted on the mandrel stem is reduced until such time that further resistance to the mandrel head displacement results from compression of the rivet body against the workpiece whereby there is a subsequent gradual increase in load on the rivet stem until the mandrel breaks in a conventional manner. Such loads are readily measured by the user of such piezo-electric thin film load measuring devices.

This type of load measuring device has a specific beneficial application in monitoring a "free set" rivet setting operation whereby the rivet setting tool may inadvertently be operated remote from the workpiece so as to effectively set the rivet in free air. During a conventional rivet setting operation, as discussed above, the load exerted on a rivet mandrel will increase gradually until such time that the mandrel head is drawn into the rivet body followed by a subsequent drop in determined load, resultant from the decreased resistance by the deforming rivet body. Subsequently, the deformed rivet body will engage the rear of a workpiece into which the rivet is being set, thereby preventing continued deformation and thus increasing resistance to displacement of the mandrel and an increase in the value of the load applied to the rivet by the setting tool until such time that the mandrel breaks and the applied load then rapidly decreases. As is well understood, such load measurements produce a conventional load profile for the rivet and it has been determined that the time difference between the first load peak, (representative of the entry load value of the rivet), and the second, setting load peak, (equal to the load at which the mandrel breaks) remains substantially constant for a particular design of rivet when applied to a particular workpiece. It is also well understood that if the rivet is "free set" so as to be set when remote from the workpiece, then the deformation stage of the rivet body is longer, since it is not arrested by engagement with the rear of the workpiece. In this situation, the rivet setting time (the time taken until the mandrel is caused to break) will occur at a time period greater than that expected when the rivet is set in a known workpiece. Thus be using the thin film load measuring devices as discussed above to measure a signal indicative of the load being applied to a mandrel and to analyse that signal as a function of time to determine the time difference between the two measured peaks of such a load curve will produce a time difference value which can be compared against a predetermined value (which is indicative of a acceptable setting procedure of a particular type of rivet in a known workpiece), to determine if the measured time difference is greater than the predetermined time difference. In the event that such time difference is greater than the predetermined value, this is to be taken as indicative of a "free setting" operation and an appropriate alarm or reject signal could be generated by an appropriate control circuit indicative of a "free set" operation to either warn the operator or to create an entry in a setting tool log as appropriate.

In an alternative embodiment of the present invention, not shown, it is also readily understood that alternative piezo-electric generators or sensors are available which do not operate in response to a bending operation but can, in fact, generate a suitable output voltage depending simply on the compressive force applied thereto. For example, for a conventional single layer piezo-electric generator, such as a single sheet of piezo ceramic material, when a mechanical stress or load applied in a single direction which is parallel to polarisation, a voltage is generated which tries to return the piezo-electric material to its original thickness. Again analysis of this generated voltage is indicative of the force being applied to such piezo-electric material. Thus in a simplified version of the current invention the front-end plate (218) could be maintained in rigid (non cantilevered) engagement with the front-end of the rivet setting tool (12) whereby such a single layer piezo-electric load generating device could then be mounted securely on the front face (220) of the tool to be compressed by the flange (122) of the rivet (in the manner previously discussed) to provide an output signal indicative of the load being exerted on the mandrel stem. In either case, the use of such piezo-electric materials to measure the setting load of this type of operation is measured directly from engagement with the rivet during the setting operation. Furthermore, since the piezo-electric device is mounted externally of the rivet setting tool (12) it is readily accessible for repair or replacement as necessary thus providing an inexpensive and convenient load measuring device for mounting on an appropriate rivet setting tool.

Whilst the present invention has been described with reference to a conventional blind rivet, it would be understood that this type of sensor arrangement is equally applicable to other types of blind fasteners which require mechanical deformation (or squeezing) of the fastener against an end portion of a setting tool whereby such compression between the fastener and the setting tool can thus be measured by insertion of an appropriate piezo-electric device of the type described herein.

The invention claimed is:

1. A blind fastener setting tool having a front end face against which a blind fastener is held during a setting operation, and having a piezo-electric thin film load measuring device mounted on said front end face so as to be disposed and compressed between said front end face and a fastener during said setting operation, said tool further having a pair of movable jaws configured to engage the fastener during said setting operation.

2. A blind fastener setting tool having a front end face against which a blind fastener is held during a setting operation, and having a piezo-electric thin film load measuring device mounted on said front end face so as to be disposed and compressed between said front end face and a fastener during said setting operation and wherein said front end face is mounted on said tool by a bridge member so as to form a cantilever.

3. A setting tool as claimed in claim 2 wherein said load measuring device comprises a bending piezo-electric generator securely mounted on said front end face, wherein bending deformation of said generator generates a low voltage electrical signal.

4. A setting tool as claimed in claim 1, wherein the front end face has a central aperture therethrough in communication with said internal mechanism of said tool, which aperture being co-axial with a longitudinal axis of said setting tool for receipt of a mandrel of said fastener, and said load measuring device also comprises an aperture so as to be mounted co-axial with said tool axis.

5. A setting tool as claimed in claim 2, further comprising a protective cover mounted on an external face of said measuring device.

6. A blind fastener setting tool having a front end face against which a blind fastener is held during a setting operation, and having a piezo-electric thin film load measuring device mounted on said front end face so as to be disposed and compressed between said front end face and a fastener during said setting operation, wherein said piezo-electric thin film load measuring device generates a voltage signal related to the load exerted on the fastener, and further including a control circuit connected to receive said voltage output from said piezo-electric thin film load measuring device for measuring the load exerted on said fastener.

7. A method of measuring the load exerted on a blind fastener by a fastener setting tool during a setting operation comprising the steps of positioning a piezo-electric thin film load measuring device between a front end face of said tool and said fastener, compressing said fastener towards said front end face during the setting operation so as to compress and plastically deform the fastener and deform the measuring device, measuring a voltage signal created as a result of deformation of said piezo-electric thin film load measuring device and analyzing said signal as indicative of the load exerted on said fastener.

8. A method of measuring the load exerted on a blind fastener by a fastener setting tool during a setting operation comprising the steps of positioning a piezo-electric thin film load measuring device between a front end face of said tool and said fastener, compressing said fastener towards said front end face during the setting operation so as to compress and deform the measuring device, measuring a voltage signal created as a result of deformation of said piezo-electric thin film load measuring device and analyzing said signal as indicative of the load exerted on said fastener wherein said load measuring device is mounted on a cantilevered front end face of a setting tool and said front end face is caused to bend as a compressive force is applied thereto, whereby said deformation of said piezo-electric thin film comprises a bending deformation to generate said signal.

9. A method as claimed in claim 7, comprising the further steps of determining the measured time difference between a first load peak corresponding to a mandrel entry point and a second load peak corresponding to a mandrel setting point of such fastener and comparing said measured time difference to a predetermined time difference value indicative of an optimum setting time difference and generating an output signal in the event that the measured time difference is greater than the predetermined time difference indicative of a free set operation.

* * * * *